US006082028A

United States Patent [19]

Demarchi

[11] Patent Number: 6,082,028

[45] **Date of Patent: *Jul. 4, 2000**

[54] FOOTWEAR ASSEMBLY HAVING TWO DETACHABLE ELEMENTS

[75] Inventor: Jean-Louis Demarchi, Saint-Jorioz, France

[73] Assignee: Salomon S.A., Metz-Tessy, France

[ * ] Notice: This patent is subject to a terminal disclaimer.

[21] Appl. No.: 09/298,900

[22] Filed: Apr. 26, 1999

Related U.S. Application Data

[63] Continuation of application No. 09/083,994, May 26, 1998, Pat. No. 5,933,987, which is a continuation of application No. 08/812,081, Mar. 6, 1997, abandoned.

[30] Foreign Application Priority Data

Mar. 18, 1996 [FR] France ..... 96.03565

[51] Int. Cl.[7] ..... A43B 5/04

[52] U.S. Cl. ..... 36/115; 36/117.6; 36/55; 36/10

[58] Field of Search ..... 36/115, 117.6, 36/55, 10, 58.5, 58.6

[56] References Cited

U.S. PATENT DOCUMENTS

| | | | |
|---|---|---|---|
| 811,316 | 1/1906 | McPherson | 36/50.1 X |
| 1,663,221 | 3/1928 | Scroggins | 36/89 |
| 1,708,156 | 4/1929 | Scroggins | 36/89 |
| 2,096,677 | 10/1937 | Fassett . | |
| 4,282,659 | 8/1981 | Bourque et al. | 36/121 |
| 4,513,520 | 4/1985 | Koch | 36/10 X |
| 4,811,500 | 3/1989 | Maccano | 36/91 |
| 5,357,695 | 10/1994 | Lu | 36/115 |
| 5,379,529 | 1/1995 | Smith et al. | 36/92 X |
| 5,408,761 | 4/1995 | Gazzano | 36/92 X |
| 5,564,203 | 10/1996 | Morris | 36/50.1 |

FOREIGN PATENT DOCUMENTS

| | | |
|---|---|---|
| 2668072 | 4/1992 | France . |
| 1191717 | 4/1965 | Germany . |

*Primary Examiner*—Ted Kavanaugh
*Attorney, Agent, or Firm*—Greenblum & Bernstein, P.L.C.

[57] ABSTRACT

Footwear assembly for the practice of a sport, especially an in-line roller skate boot, of the type including two elements of which one, internal, is relatively flexible and forms a removable liner or boot, and the other, external, is relatively rigid and includes a shell, provided with a longitudinally opening at its upper portion to allow for the introduction of the liner or boot in the shell. The tightening of the footwear assembly on the foot is done means of a lace connecting the internal and external edges of the opening to one another, which lace is also adapted to cooperate simultaneously with the rigid shell, via a linkage, wherein the linking of the liner or boot to the shell is constituted by at least one strap extending from each of the lateral zones of the liner or boot to which it is affixed and positioned opposite corresponding passages which are also provided on each of the lateral portions of the rigid shell, the length of each strap being provided so as to be capable of externally overlapping the lateral sides of the shell, and at least one upper portion of the liner or boot to which it is connected by means of the lace cooperating in traction with the free end of each of the straps.

28 Claims, 1 Drawing Sheet

FOOTWEAR ASSEMBLY HAVING TWO DETACHABLE ELEMENTS

CROSS-REFERENCE TO RELATED APPLICATION

This application is a continuation of application Ser. No. 09/083,994, filed on May 26, 1998 U.S. Pat. No. 5,933,987, which is a continuation of application Ser. No. 08/812,081, Mar. 6, 1997 the abandoned disclosures of which are hereby incorporated by reference thereto in their entirety and the priorities of which are claimed under 35 USC 120.

This application is also based upon French application No. 96.03565, filed on Mar. 18, 1996, the disclosure of which is hereby incorporated by reference thereto in its entirety and priority of which is hereby claimed under 35 USC 119.

BACKGROUND OF THE INVENTION

1. Field of the Invention

The present invention relates to a footwear assembly for sport practice, especially an in-line roller skate boot.

2. Description of Background and Material Information

In certain known embodiments, this type of boot includes two elements one of which, internal and relatively flexible, forms a removable boot or liner, and the other, external and relatively rigid, forms a shell including at least one lower portion, affixed to the upper plate of the skate. This shell is longitudinally open at its upper portion to allow for the introduction of the liner or boot. Tightening is then done on the foot by means of a single lace joining to one another the internal and external quarters of such opening. The lace in this case is also capable of simultaneously cooperating with the rigid shell via linkage means.

An assembly of this type is known from the non-published commonly owned Patent Application No. 96.00833, filed on Jan. 22, 1996.

Thus, a drawback lying in the fact that it is always tedious for a user to have to make a first lacing of the internal element, the liner, and a second lacing of the external element, the shell, affixed to the ski or other sports item, such as in-line rollers, has been remedied.

The assembly described in the aforementioned patent application does not have any particular drawback.

SUMMARY OF THE INVENTION

An object of the present invention is to propose a particularly simple alternative embodiment of a footwear assembly, that can be easily disassembled, so as to easily dissociate the liner from the remainder of the assembly for the cleaning thereof, for example, while ensuring a perfect linkage without play of the liner or internal element to the rigid external element.

To this end, the invention relates to a footwear assembly for sport practice, especially a roller or in-line roller skate boot, of the type including two elements of which one, internal, is relatively flexible and forms a removable liner or boot, and the other, external, is relatively rigid and includes a shell, affixed to the upper plate of a skate, open longitudinally at its upper portion to allow for the introduction of the liner or boot, then the tightening thereof on the foot, by means of a lace connecting the internal and external edges of the opening to one another, which lace is also adapted to cooperate simultaneously with the rigid shell, via a linkage, wherein the linkage between the liner or boot and the shell is constituted by at least one strap coming from each of the lateral zones of the liner or boot to which it is affixed and positioned opposite corresponding passages which are also provided on each of the lateral portions of the rigid shell, the length of each strap being provided so as to be capable of overlapping the lateral sides of the shell, and at least one upper portion of the liner or boot to which it is connected by means of the lace cooperating in traction with the free end of each of the straps, so as to simultaneously perform the tightening of the liner or boot and the linkage of the liner or boot to the shell.

The present invention is also related to the characteristics which will become apparent along the following description, and which must be considered separately or according to all of their possible technical combinations.

BRIEF DESCRIPTION OF THE DRAWINGS

This description, provided by way of a non-limiting example, will help to better understand how the invention can be embodied, with reference to the annexed drawings, in which.

DETAILED DESCRIPTION OF THE PREFERRED EMBODIMENTS

Figure 1:
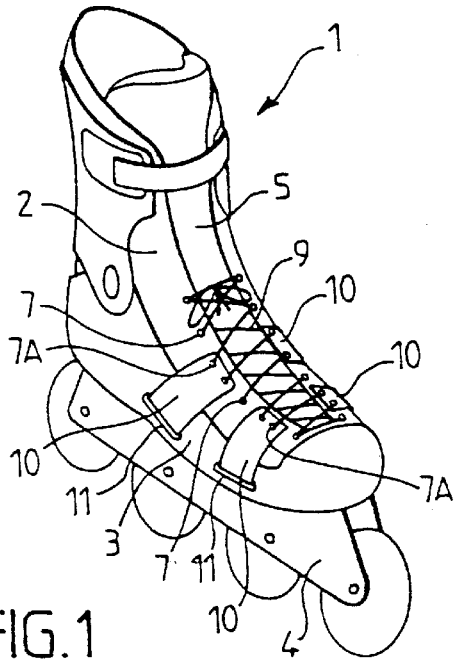
FIG. 1 shows a perspective view of an in-line roller skate equipped with a footwear assembly according to the invention.
Figure 2:
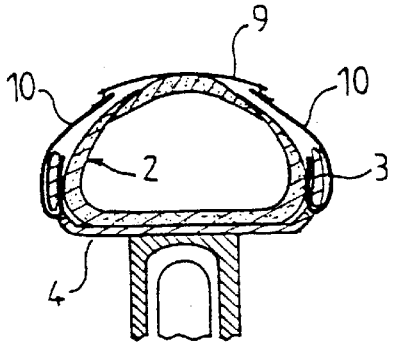
FIG. 2 shows a transverse cross sectional view of a skate according to FIG. 1, taken at right angles with the means for tightening and linking a removable liner or boot in a shell base affixed to the frame.
Figure 3:
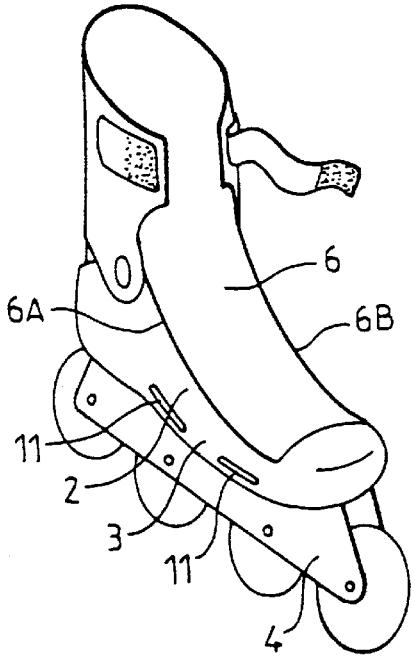
FIG. 3 shows a perspective view of a skate according to FIG. 1 from which the liner has been removed.
Figure 4:
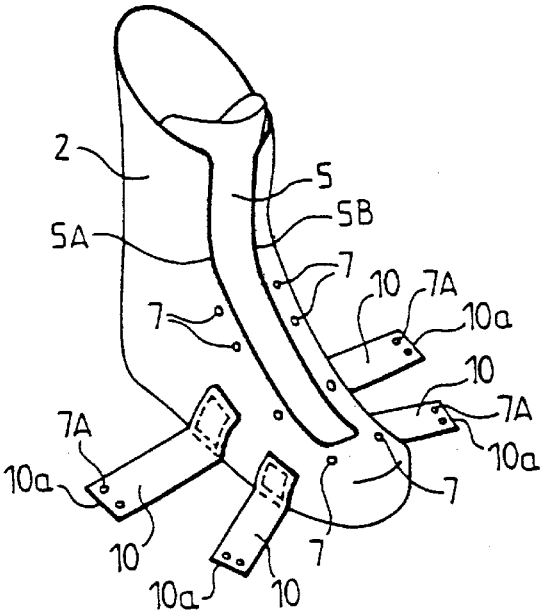
FIG. 4 shows a perspective view of a liner removed from the shell base of the skate, according to FIG. 3.

The in-line roller skate 1 designated in the drawing is only cited by way of a concrete example of the invention. It is obvious that it could be any other type of sport boot or footwear assembly for sport practice.

This is a footwear assembly including two elements of which one, internal 2, is in fact constituted by a removable walking liner or boot, and the other, external, is in this case constituted by a relatively rigid shell base 3 affixed to an upper plate 4 of the skate 1 and capable of receiving the liner or flexible boot 2. In the example shown, the external rigid element is completed by a rigid collar 15 journalled on the shell base and adapted to surround the user's ankle in a known manner.

Each of these internal 2 or external 3 elements, therefore the liner or the boot and the shell base, includes an opening 5 and 6, respectively, for introducing the foot.

These openings 5 and 6 are each demarcated by an internal or medial edge 5A and an external or lateral edge 5B for one, and 6A, 6B, for the other.

Eyelets 7 or other similar means for passage of a lacing, such as a cable or lace 9 are arranged on the edges 5A and 5B of the opening 5 of the internal element 2.

The tightening action on the internal 5A and external 5B edges, respectively, of the opening 5 occurs by traction on a single lace or cable 9, connecting the aforementioned eyelets 7 to one another, along a predetermined alternating path, to constitute a closure device and single linkage of the footwear assembly, during a traction on the ends of the lace 9 which then tightens the edges 5A and 5B to bring them closer together and maintain them in the tightening position on the foot.

According to the invention, the linking of the liner or boot 2 to the shell base 3 is accomplished by at least one strap 10 extending from each of the lateral zones of the liner or boot 2 to which it is affixed, each strap being positioned opposite slots or other corresponding passages 11 provided on each of the lateral portions of the rigid shell base 3, the length of each strap 10 being provided so as to be capable, after passing through the slots 11, of externally overlapping the lateral sides of the shell base 3, and preferably at least one upper portion of the liner or boot 2, by means of the lace 9 cooperating in traction with the free end 10*a* of each of the straps 10, simultaneously to the tightening of the liner 2 on the foot.

The cooperation of the lace 9 with each of the free ends 10*a* of the straps 10 occurs via lacing elements, such as hooks or eyelets 7*a* obtained on the ends 10*a*, and in which the lace 9 passes. These hooks or eyelets 7A are positioned and provided in a number such that they can be inserted between a series of hooks or eyelets 7 arranged on each internal 5A and external 5B edge, respectively, of the liner or boot 2, in a manner so as to simultaneously ensure the tightening of the liner or boot 2 and linkage thereof to the shell base 3, but independently of one another.

According to the present example of the invention, the liner 2 includes, on both sides of its opening 5 and preferably arranged on its lower lateral zones, two straps 10 which are attached thereto opposite four corresponding slots 11 of the shell base 2.

As a result, the free ends 10*a* of each of the straps 10 include two hooks or eyelets 7A adapted to cooperate with the tightening lace 9, further cooperating with the hooks or eyelets 7 of the liner 2.

Preferably, the straps 10 of each pair of openings 5 are arranged opposite one another on both sides of the lateral zones of the liner 2, in the zone of the metatarsal bones and of the arch of the foot.

According to the present example of embodiment, the straps 10 are attached on the lateral zones of the liner 2 by stitching.

According to an alternative embodiment, the straps 10 are constituted by lateral extensions of a sole or insole of the liner 2 (not shown on the drawing).

The instant application is based on priority French Patent Application No. 96.03565, filed on Mar. 18, 1996, the disclosure of which is hereby expressly incorporated by reference thereto, and the priority of which is hereby claimed under 35 USC 119.

Although the invention has been described with reference to particular configurations and embodiments, it is to be understood that the invention is not limited to the particulars expressly disclosed, but the invention extends to all equivalents within the scope of the claims that follow.

What is claimed is:

1. A boot comprising:

one of an internal and relatively flexible element and a removable walking liner and a boot forming a liner having lateral zones and a first longitudinally extending opening defined by opposite lateral edges;

an external and relatively rigid element, including a shell, said shell being provided with lateral portions and a second longitudinally extending opening to allow for introduction of said liner within said shell;

a lacing between and connecting said opposite lateral edges of said liner;

a linkage between said lacing and said shell, said linkage comprising:

at least one strap extending from each of said lateral zones of said liner, each of said at least one strap having a free end;

at least one passage provided on each of said lateral portions of said shell for receiving a respective one of said at least one strap, each of said at least one strap extending from a respective passage, externally overlapping a part of one of said lateral sides of said shell and a part of one of said lateral zones of said liner, said lacing being connected to said free end of said at least one strap on each of said lateral zones of said liner for connecting said free ends of said straps in traction.

2. A boot according to claim 1, wherein:

the shell comprises a skate boot.

3. A boot according to claim 1, further comprising:

an assembly of in-line rollers, including an upper plate; and said shell is attached onto said upper plate.

4. A boot according to claim 1, wherein:

said opposite lateral edges of said liner include lacing elements for connecting said lacing to said liner to ensure tightening of said liner; and each free end of said at least one strap including lacing elements for connecting said lacing to said at least one strap and, thereby, for ensuring a connection between said liner and said shell.

5. A boot according to claim 4, wherein:

said lacing elements of said liner and said at least one strap comprise eyelets or hooks.

6. A boot according to claim 1, wherein:

each of said opposite lateral edges of said liner include a plurality of lacing elements for connecting said lacing to said liner to ensure tightening of said liner; and each free end of said at least one strap including lacing elements for connecting said lacing to said at least one strap and, thereby, for ensuring a connection between said liner and said shell, said lacing elements of said at least one strap being positioned longitudinally between lacing elements of said liner.

7. A boot according to claim 6, wherein:

said lacing elements of said liner and said at least one strap comprise eyelets or hooks.

8. A boot according to claim 1, wherein:

said at least one passage comprises two passages provided on each of a lower zone of each of said lateral portions of said shell; and said at least one strap comprises two straps extending from each of said lateral zones of said liner, each of said straps being positioned opposite a respective one of said passages for passage of each strap through a respective passage.

9. A boot according to claim 8, wherein:

on each of said lateral zones of said liner, a strap extends from a zone corresponding to metatarsal bones of a foot of a wearer and a strap extends from a zone corresponding to an arch of the foot.

10. A boot according to claim 1, wherein:

each of said straps is affixed to said liner by stitching.

11. A boot according to claim 1, wherein:

said liner includes a sole; and each of said straps is constituted by lateral extensions of said sole of said liner.

12. A boot comprising:

one of an internal and relatively flexible element and a removable walking liner and a boot forming a liner having lateral zones and a first longitudinally extending opening defined by opposite lateral edges;

an external and relatively rigid element, including a shell, said shell being provided with lateral portions and a second longitudinally extending opening to allow for introduction of said liner within said shell;

at least one strap extending from each of said lateral zones of said liner, each of said at least one strap having a free end;

at least one passage provided on each of said lateral portions of said shell for receiving a respective one of said at least one strap, each of said at least one strap extending from a respective passage, externally overlapping a part of one of said lateral sides of said shell and a part of one of said lateral zones of said liner; and a lacing connected at least to said free end of said at least one strap on each of said lateral zones of said liner for connecting said free ends of said straps in traction.

13. A boot according to claim 12, wherein:

the shell comprises a skate boot.

14. A boot according to claim 12, further comprising:

an assembly of in-line rollers, including an upper plate; and said shell is attached onto said upper plate.

15. A boot according to claim 12, wherein:

said opposite lateral edges of said liner include lacing elements for connecting said lacing to said liner to ensure tightening of said liner; and each free end of said at least one strap including lacing elements for connecting said lacing to said at least one strap and, thereby, for ensuring a connection between said liner and said shell.

16. A boot according to claim 15, wherein:

said lacing elements of said liner and said at least one strap comprise eyelets or hooks.

17. A boot according to claim 12, wherein:

each of said opposite lateral edges of said liner include a plurality of lacing elements for connecting said lacing to said liner to ensure tightening of said liner; and each free end of said at least one strap including lacing elements for connecting said lacing to said at least one strap and, thereby, for ensuring a connection between said liner and said shell, said lacing elements of said at least one strap being positioned longitudinally between lacing elements of said liner.

18. A boot according to claim 17, wherein:

said lacing elements of said liner and said at least one strap comprise eyelets or hooks.

19. A boot according to claim 12, wherein:

said at least one passage comprises two passages provided on each of a lower zone of each of said lateral portions of said shell; and said at least one strap comprises two straps extending from each of said lateral zones of said liner, each of said straps being positioned opposite a respective one of said passages for passage of each strap through a respective passage.

20. A boot according to claim 12, wherein:

on each of said lateral zones of said liner, a strap extends from a zone corresponding to metatarsal bones of a foot of a wearer and a strap extends from a zone corresponding to an arch of the foot.

21. A boot according to claim 12, wherein:

each of said straps is affixed to said liner by stitching.

22. A boot according to claim 12, wherein:

said liner includes a sole; and each of said straps is constituted by lateral extensions of said sole of said liner.

23. A skate boot comprising:

one of an inner flexible liner and a removable walking liner having opposite lateral zones and a first longitudinally extending opening having a predetermined width;

an outer rigid shell comprising a second longitudinally extending opening wider than said first opening so that said shell partially overlaps said inner flexible liner or said removable walking liner;

a tightening device to tighten a foot received within the inner flexible liner or the removable walking liner;

a linkage connecting said tightening device to said rigid shell, said linkage comprising at least one strap, each of said at least one strap having a free end and an end attached to one of said lateral zones of said inner flexible liner or said removable walking liner; and at least one slot extending through said shell to allow passage of said at least one strap, said free end of said at least one strap being connected to said tightening device for being placed into tension.

24. A skate boot according to claim 23, wherein:

said tightening device is connected to said inner flexible liner or said removable walking liner to tighten a foot received within said inner flexible liner or said removable walking liner by reducing said width of said first longitudinally extending opening.

25. A skate boot according to claim 23, wherein:

said opposite lateral zones of said inner flexible liner or said removable walking liner include lacing elements and said free ends of said at least one strap including lacing elements; and said tightening device comprises a lace connecting said lacing elements of said inner flexible liner or said removable walking liner and said at least one strap.

26. A skate boot comprising:

a boot having opposite lateral zones and a first longitudinally extending opening having a predetermined width;

an outer rigid shell comprising a second longitudinally extending opening wider than said first opening so that said shell partially overlaps said boot;

a tightening device to tighten a foot received within the boot;

a linkage connecting said tightening device to said rigid shell, said linkage comprising at least one strap, each of said at least one strap having a free end and an end attached to one of said lateral zones of said boot; and at least one slot extending through said shell to allow passage of said at least one strap, said free end of said at least one strap being connected to said tightening device for being placed into tension.

27. A skate boot according to claim 26, wherein:

said tightening device is connected to said boot to tighten a foot received within said boot by reducing said width of said first longitudinally extending opening.

28. A skate boot according to claim 26, wherein:

said opposite lateral zones of said boot include lacing elements and said free ends of said at least one strap including lacing elements; and said tightening device comprises a lace connecting said lacing elements of said boot and said at least one strap.

* * * * *